US008931288B2

(12) United States Patent
Qu et al.

(10) Patent No.: US 8,931,288 B2
(45) Date of Patent: Jan. 13, 2015

(54) PRESSURE REGULATION OF AN AIR CONDITIONER

(71) Applicants: Yi Qu, Coppell, TX (US); Der-Kai Hung, Dallas, TX (US)

(72) Inventors: Yi Qu, Coppell, TX (US); Der-Kai Hung, Dallas, TX (US)

(73) Assignee: Lennox Industries Inc., Richardson, TX (US)

( * ) Notice: Subject to any disclaimer, the term of this patent is extended or adjusted under 35 U.S.C. 154(b) by 260 days.

(21) Appl. No.: 13/656,441

(22) Filed: Oct. 19, 2012

(65) Prior Publication Data

US 2014/0109605 A1 Apr. 24, 2014

(51) Int. Cl.
*F25B 1/00* (2006.01)

(52) U.S. Cl.
USPC ..... 62/115; 62/197

(58) Field of Classification Search
CPC ..... F25D 19/02; F25D 2400/40
USPC ..... 62/115, 118, 196.1, 196.3, 197, 498
See application file for complete search history.

(56) References Cited

U.S. PATENT DOCUMENTS

| | | | | |
|---|---|---|---|---|
| 4,507,934 | A | 4/1985 | Tanaka et al. | |
| 4,785,640 | A | 11/1988 | Naruse | |
| 5,095,714 | A | 3/1992 | Adachi et al. | |
| 6,192,695 | B1 | 2/2001 | Hirota | |
| 6,644,066 | B1 | 11/2003 | Dolcich | |
| 6,675,594 | B2 | 1/2004 | Choi et al. | |
| 7,765,818 | B2 * | 8/2010 | Buck | 62/180 |
| 8,136,364 | B2 | 3/2012 | Lifson et al. | |
| 2011/0000234 | A1 * | 1/2011 | Nishimura et al. | 62/77 |
| 2011/0048046 | A1 * | 3/2011 | Sommer et al. | 62/228.1 |
| 2011/0185760 | A1 * | 8/2011 | Suh et al. | 62/344 |

* cited by examiner

*Primary Examiner* — Mohammad M Ali
(74) *Attorney, Agent, or Firm* — Klemchuk Kubasta LLP; Elizabeth Philip Dahm; Shannon W. Bates

(57) ABSTRACT

In various implementations, air conditioners may include a high pressure portion and a low pressure portion. A bypass line may divert a portion of the refrigerant from the high pressure portion to the low pressure portion to reduce the pressure of at least a part of the high pressure portion. The bypass line may be opened automatically.

20 Claims, 3 Drawing Sheets

PRESSURE REGULATION OF AN AIR CONDITIONER

TECHNICAL FIELD

The present disclosure relates to air conditioners.

BACKGROUND

During operation of an air conditioner, gaseous refrigerant enters a condenser and, due to heat transfer with air from a condenser fan, is condensed into a liquid. The liquid refrigerant may flow to an evaporator through a metering device. In the evaporator, warm air from an evaporator blower may transfer heat to the cooler refrigerant, cooling the air. The cool air may then be transferred to different areas (e.g., via ducts), as desired. The refrigerant leaves the evaporator as a hot gas, due the heat transfer with the warm air in the evaporator, and enters the compressor. In the compressor, the pressure of the gas is increased and the pressurized gas is returned to the condenser.

SUMMARY

In various implementations, an air conditioning system may include a high pressure portion, a low pressure portion, a property sensor, a bypass line and a valve. The high pressure portion may include a microchannel condenser. A pressure of a refrigerant in at least a portion of the high pressure portion may be greater than a pressure of refrigerant in at least a portion of the low pressure portion. The property sensor may detect a property reading that is at least partially based on a property of the refrigerant in at least a portion of the high pressure portion. The bypass line may couple at least a part of the high pressure portion and a part of the low pressure portion. Opening the bypass line may reduce a pressure of at least a portion of the microchannel condenser. A valve may be coupled to the bypass line, and may open at least partially based on the pressure reading.

Implementations may include one or more of the following features. A property reading may include at least one of a temperature, a pressure, a temperature differential, or a pressure differential, a change in temperature, or a change in pressure. The air conditioner may include a compressor and the property reading may include a pressure differential between a pressure of the refrigerant proximate an inlet of the compressor and a pressure of the refrigerant proximate an inlet of the high pressure portion. The inlet of the high pressure portion may be proximate an outlet of the compressor. The property reading may include a pressure differential between a portion of the high pressure portion and a portion of the low pressure portion. The bypass line may couple a first line proximate an outlet of the compressor and a second line proximate an inlet of the compressor. The high pressure portion may include at least a portion of the first line, and the low pressure portion may include at least a portion of the second line. The bypass line may couple a first line proximate an outlet of the microchannel condenser and second line proximate an inlet of an evaporator of the low pressure portion. The high pressure portion may include at least a portion of the first line and the low pressure portion may include at least a portion of the second line. The valve may automatically open when the property reading exceeds a predetermined maximum property. The valve may automatically close when the property reading is below a predetermined closing value for a property. The valve may open when the pressure reading exceeds a predetermined maximum property and the valve may close when the property reading is less than approximately the predetermined maximum property. The valve may automatically close when a pressure reading is less than a predetermined closing property value.

In various implementations, a pressure reading may be determined at least partially based on a pressure of refrigerant in at least a portion of a high pressure portion of an air conditioner. The high pressure portion may include a microchannel condenser. A determination may be made whether the pressure reading exceeds a predetermined maximum pressure. A part of the refrigerant in the high pressure portion may be allowed to flow to a low pressure portion of the air conditioner through a bypass line. A pressure in at least a part of the microchannel condenser may be reduced by allowing the part of the refrigerant to flow through the bypass line.

Implementation may include one or more of the following features. A flow of the refrigerant through the bypass line may be restricted, if the pressure reading does not exceed a predetermined maximum pressure. A valve disposed in the bypass line may be automatically closed when the pressure reading does not exceed the predetermined maximum pressure. Determining the pressure reading may include measuring a pressure differential between an outlet of a compressor of the air conditioner and an inlet of the compressor. A signal may be transmitted to a valve disposed in the bypass line based on the determination of whether the pressure reading exceeds a predetermined maximum pressure. Allowing a part of the refrigerant in the high pressure portion to flow to the low pressure portion through the bypass line may include allowing a part of the refrigerant in a first line proximate an outlet of a compressor of the air conditioner to flow to a second line proximate an inlet of the compressor. Allowing a part of the refrigerant in the high pressure portion to flow to the low pressure portion through the bypass line may include allowing a part of the refrigerant in a first line proximate an outlet of the condenser to flow to a second line proximate an inlet of an evaporator of the air conditioner.

In various implementations, a property reading of an air conditioner may be determined. The air conditioner may include a microchannel condenser. A determination may be made whether the property reading exceeds a predetermined maximum property. A part of the refrigerant in a high pressure portion of the air conditioner may be allowed to flow to a low pressure portion of the air conditioner through a bypass line, if the property reading exceeds the predetermined maximum property. A pressure in at least a part of the condenser may be reduced by allowing the part of the refrigerant to flow through the bypass line.

Implementations, may include one or more of the following features. The property reading may include at least one of ambient temperature, temperature of the refrigerant proximate an outlet of a compressor of the air conditioner, temperature of the refrigerant proximate an inlet of the condenser, pressure of the refrigerant proximate an outlet of the compressor, or pressure of the refrigerant proximate an inlet of the condenser. A flow of the refrigerant through the bypass line may be restricted, if the pressure reading does not exceed the predetermined maximum pressure. Allowing a part of the refrigerant in the high pressure portion to flow to the low pressure portion through the bypass line may include allowing a part of the refrigerant in a first line proximate an outlet of a compressor of the air conditioner to flow to a second line proximate an inlet of the compressor and/or allowing a part of the refrigerant in a first line proximate an outlet of the condenser to flow to a second line proximate an inlet of an evaporator of the air conditioner.

The details of one or more implementations are set forth in the accompanying drawings and the description below. Other features, objects, and advantages of the implementations will be apparent from the description and drawings.

BRIEF DESCRIPTION OF THE DRAWINGS

For a more complete understanding of this disclosure and its features, reference is now made to the following description, taken in conjunction with the accompanying drawings, in which.

Like reference symbols in the various drawings indicate like elements.

DETAILED DESCRIPTION

Air conditioners may have sensitivities during operation. For example, air conditioners may include microchannel condensers (e.g., condenser with a channel size less than approximately 1 mm) rather than other types of condensers (e.g., condenser with tube size greater than 5 mm). Microchannel condensers may be sensitive to operating conditions during operations. For example, when ambient temperatures (e.g., temperatures proximate a condenser or temperature proximate a condenser fans) are high, the pressure in the microchannel condenser may become elevated due to the refrigerant capacity size difference between the microchannel condenser and the evaporator. The high pressures (e.g., pressures greater than approximately 615 psi) may cause mechanical failure, including prefailure events, such as excessive wear on parts.

Figure 1:
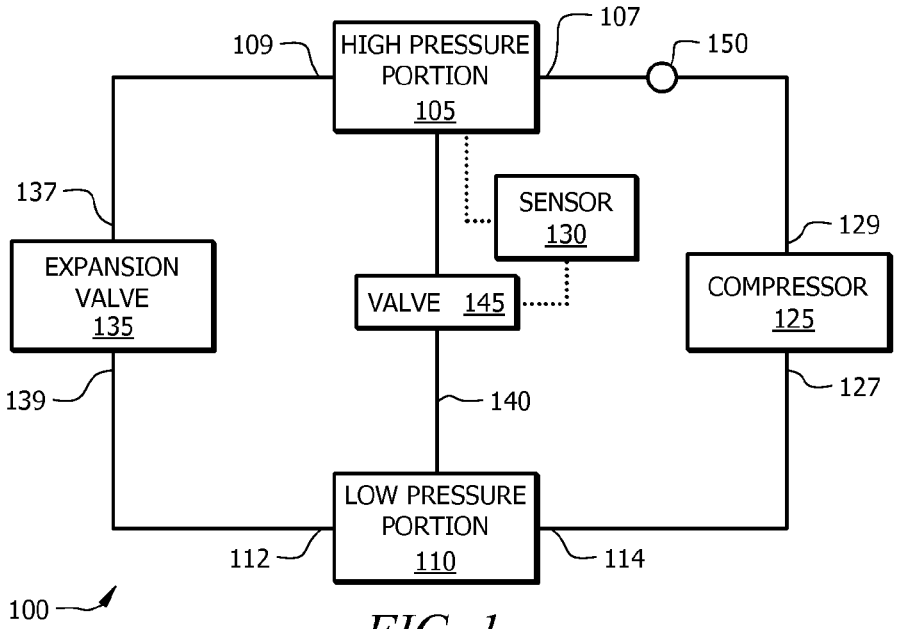
FIG. 1 illustrates an implementation of an example air conditioning system.
Figure 2:
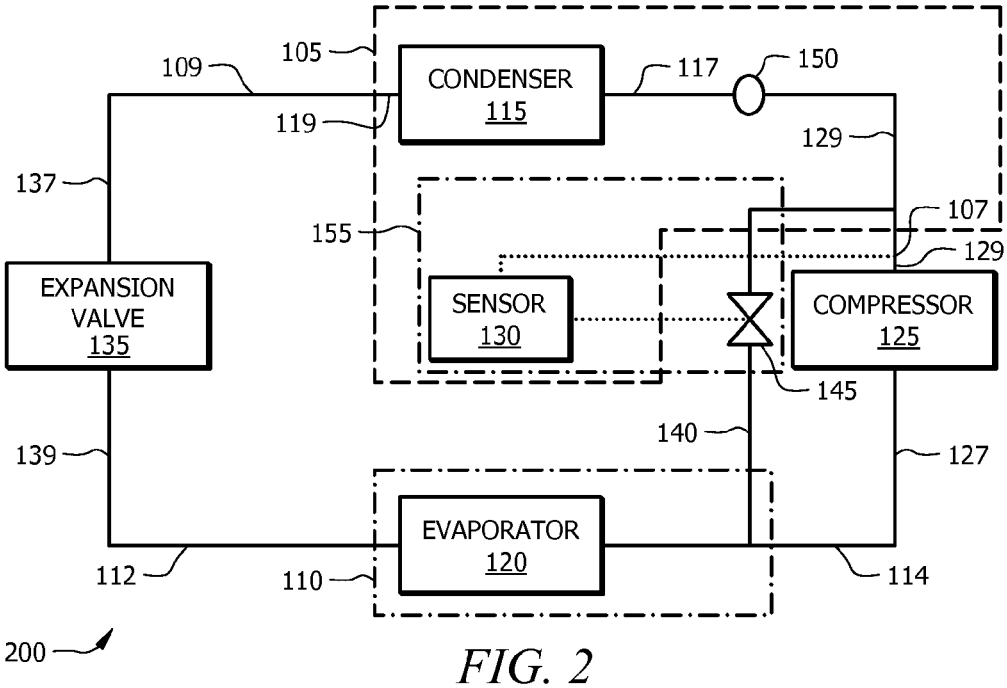
FIG. 2 illustrates an implementation of an example air conditioner.
Figure 3:
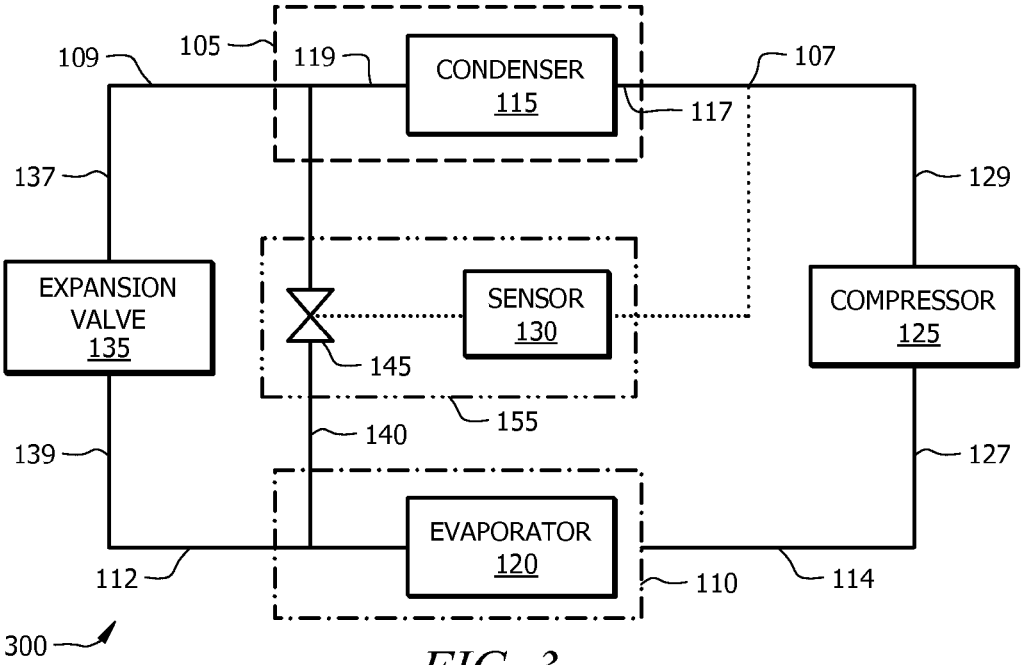
FIG. 3 illustrates an implementation of an example air conditioner.

FIG. 1 illustrates an implementation of an example air conditioning system 100. FIG. 2 illustrates an implementation of an example air conditioning system 200, and FIG. 3 illustrates an implementation of an example air conditioning system 300. The air conditioning system 100, 200, 300 may include a high pressure portion 105 and a low pressure portion 110.

A pressure in various components or portions thereof in high pressure portion may be higher than low pressure portion. For example, a pressure of refrigerant proximate an inlet 107 of the high pressure portion 105 may be greater than a pressure of the refrigerant proximate an inlet 112 and/or outlet 114 of the low pressure portion 110. A pressure of refrigerant proximate an outlet 109 of the high pressure portion may be greater than a pressure of the refrigerant proximate an inlet 112 and/or an outlet 114 of the low pressure portion 114. In some implementations, an average pressure across a high pressure portion 105 may be greater than the average pressure across a low pressure portion 110.

The air conditioning system 100, 200, 300 may include various components, such as a condenser 115, an evaporator 120, a compressor 125, sensors 130, an expansion valve 135, various lines such as a bypass line 140, a valve 145, and/or a high pressure switch 150. Component(s) and/or portions thereof may be included in the high pressure portion 105 and/or low pressure portions 110.

The high pressure portion 105 may include various components of the air conditioning system, such as a condenser 115, sensors 130, high pressure switch 150, and/or portions thereof. For example, as illustrated in FIG. 2, the high pressure portion 105 includes condenser 115, high pressure switch 150, at least a portion of the control device 155, and valve 145. The inlet 107 of the high pressure portion may be proximate the outlet 129 of the compressor 125. As illustrated in FIGS. 3, the high pressure portion 105 includes condenser 115. The inlet 107 of the high pressure portion 105 may be proximate the inlet 117 of the condenser 115 and/or the outlet 109 of the high pressure portion 105 may be proximate the outlet 119 of the condenser.

In some implementations, the condenser may be a microchannel condenser. A microchannel condenser may include channels less than approximately 1 mm. The channels of the microchannel condenser may have a cross-sectional area similar to a rectangle, an oval, and/or any other appropriate shape. A microchannel condenser may increase the efficiency and/or decrease energy consumption of an air conditioner (e.g., when compared to an air conditioner with a condenser with a tubing diameter greater than 5 mm). A microchannel condenser may be able to operate with less refrigerant (e.g., when compared to an air conditioner with a condenser with a tubing diameter greater than 5 mm).

The low pressure portion 110 may include various components of the air conditioner, such as the evaporator 120, sensors 130, and/or portions thereof. For example, as illustrated in FIGS. 2 and 3, the low pressure portion 110 includes an evaporator 120.

As illustrated in FIGS. 1, 2, and 3, the refrigerant may flows from the outlet 129 of the compressor 125 to the high pressure portion 105. A sensor 130 may be coupled to the fluid line between the compressor 125 and the high pressure portion 105. The sensor 130 may detect a property of the air conditioning system 100, 200, 300. For example, the sensor 130 may detect properties such as temperature, pressure, and/or other appropriate properties. The sensor 130 may detect the property at various positions in lines and/or components of the air conditioning system. For example, the sensor 130 may detect a property (e.g., temperature and/or pressure) such as an ambient temperature (e.g., a temperature proximate the condenser). The sensor may detect a property of the air conditioning system 100, 200, 300 proximate an inlet 107 and/or outlet 109 of the high pressure portion 105, an inlet 112 and/or outlet 114 of the low pressure portion 110, and/or proximate an inlet and/or outlet of a component of the air conditioner (e.g., compressor 125, condenser 115, evaporator 120, valve 145 and/or expansion valve 135). In some implementations, the sensor 130 may detect a property of at least a portion of the high pressure portion and/or low pressure portion.

In some implementations, the sensor 130 may measure a property of the air conditioning system 100, 200, 300 and determine a property reading. For example, a property reading may include a pressure, temperature, pressure differential, and/or temperature differential.

In some implementations, the sensor 130 may be a portion of and/or coupled to a control device 155, such as a smart valve and/or controller (e.g., controller for the air conditioning system, controller for the valve 145, and/or controller for the sensor 130). The control device may include a computer and/or other programmable logic device.

The refrigerant may flow from the outlet 109 of the high pressure portion 105 to an inlet 137 of the expansion valve 135. The expansion valve 135 may be a metering device, such as a thermal expansion valve. The refrigerant may flow from an outlet 139 of the expansion valve 135 to an inlet 112 of the low pressure portion 140.

The low pressure portion 140 may include an evaporator. The evaporator may have a refrigerant capacity that is greater than the microchannel condenser. When an ambient temperature is elevated (e.g., greater than approximately 116 degrees Fahrenheit and/or greater than approximately 125 degrees Fahrenheit), the capacity difference between the evaporator and the microchannel condenser may cause high pressures in the microchannel condenser (e.g., greater than 615 psig for R410A).

If air conditioner operation is allowed when the pressure exceeds a predetermined operational maximum (e.g., greater than approximately 615 psig and/or greater than approximately 620 psig for R410A), mechanical failure events may occur. For example, mechanical failure events, including pre-failure events, may include wear on parts, damage to lines, damage to seals, and/or damage to components.

The outlet 114 of the low pressure portion 110 may be coupled to the inlet 127 of the compressor 125. The compressor 125 may be a scroll compressor and/or any other appropriate compressor.

A bypass line 140 may couple at least a portion of the high pressure portion 105 and at least a portion of the low pressure portion 110. The bypass line 140 may allow refrigerant to flow from at least a portion of the high pressure portion 105 to at least a portion of the low pressure portion 110. Allowing refrigerant to flow from the high pressure portion 105 to the low pressure portion 110 may reduce a pressure of at least a portion of the high pressure portion.

The bypass line may couple various portions of the high pressure portion 105 and the low pressure portion 110 of the air conditioning system 100, 200, 300. As illustrated in FIG. 2, the air conditioning system 200 includes a bypass line 145 that couples a line proximate an outlet 129 of the compressor 125 to a line proximate the inlet 127 of the compressor and/or the outlet 124 of the evaporator 120. During elevated ambient temperatures, a pressure in an air conditioner with a microchannel condenser may increase and if flow through the bypass line is restricted, then the pressure may approach the predetermined maximum operational pressure causing the high pressure switch to restrict operation of the air conditioner. Thus, allowing flow through the bypass may allow continued operation during elevated temperatures, in some implementations.

As illustrated in FIG. 3, the air conditioning system 300 includes a bypass line 145 that couples a line proximate an outlet 117 of the condenser 115 to a line proximate an inlet 122 of the evaporator 125. For example, the bypass line 145 may allow a portion of the refrigerant to bypass the expansion valve 135. An efficiency of the air conditioning system 300, when at least a portion of the refrigerant is allowed to flow through the bypass line 145, may be approximately similar to the efficiency of the air conditioning system when refrigerant flow through the bypass line is restricted. In some implementations, an amount of refrigerant allowed to pass thorough the bypass line 145 may be restricted such that flooding the compressor may be inhibited. In some implementations, a capacity of the air conditioning system (e.g., the evaporator), when flow through the bypass line is allowed, may not be increased and/or be approximately the same as when flow through the bypass line of the system is restricted. Allowing fluid to flow through the bypass line may reduce a discharge pressure. In some implementations, a bypass line may not include an expansion valve.

During operations, as illustrated in FIGS. 1-3, refrigerant may be allowed to flow through the bypass line and reduce a pressure of the refrigerant in at least a portion of the high pressure side and/or condenser. By reducing the pressure, operation of the air conditioner may be allowed to continue without exceeding the maximum operational pressure and thus, activating the high pressure switch.

In some implementations, a part of the refrigerant in the high pressure portion 110 may flow through the bypass line 140. For example, less than 50 percent of the refrigerant in a line (e.g., a line from the high pressure portion) may be allowed to flow through the bypass line 140. In some implementations, approximately 5 to approximately 10 percent of the refrigerant may be allowed to flow through the bypass line 140. Less than 20 percent of the refrigerant in a line may be diverted to flow through the bypass line 140, in some implementations.

In some implementations, the amount of refrigerant allowed to flow through the bypass line 140 may be at least partially based on a size of the bypass line (e.g., absolute size and/or size of the bypass line compared to other lines in the air conditioning system). The size (e.g., diameter and/or cross-sectional area) of the bypass line 140 may be selected to allow a predetermined amount of refrigerant to flow through the bypass line.

In some implementations, a valve 145 coupled to the bypass line may control the amount of refrigerant allowed to pass through the bypass line. The valve 145 may be disposed in the bypass line 140. A sensor 130 may be coupled to the valve 145 and/or operations of the valve 145 may be based at least partially based on the property reading from the sensor. For example, the valve may open when a property reading exceeds a predetermined maximum property. The valve may close. For example, a valve may automatically close and restrict flow through the bypass line when a property reading does not exceed a predetermined maximum property. In some implementations, the valve may automatically operate based on the property reading. In some implementations, a controller 155 coupled to a valve 145 may control the openness of the valve to control the amount of refrigerant allowed to pass through the bypass line 140.

Allowing the refrigerant to flow through the bypass line 140 may reduce the pressure in at least a portion of the high pressure portion 105 and/or condenser 115. For example, allowing refrigerant to flow through the bypass line may reduce a pressure in a microchannel condenser 115 of the air conditioning system 100, 200, 300. By reducing the pressure in at least a portion of the microchannel condenser, the pressure may not approach the predetermined operational maximum pressure and thus the operations of the air conditioner may not be restricted (e.g., by the high pressure switch). Thus, during high ambient temperatures, the air conditioning system 100, 200, 300 may continue to operate by diverting a portion of the refrigerant through the bypass line and maintaining the pressure in the high pressure portion below a predetermined pressure (e.g., predetermined maximum pressure and/or predetermined operational maximum pressure), in some implementations.

A high pressure switch 150 may be disposed in proximate the inlet 107 of the high pressure portion 105. For example, the high pressure switch 150 may be coupled to a line proximate an inlet of the condenser 115. The high pressure switch 150 may restrict operations of the air conditioning system 100, 200, 300 and/or portions thereof (e.g., the compressor 125) when a pressure (e.g., in a line proximate the inlet of the high pressure side) exceeds a predetermined operational maximum. The high pressure switch 150 and/or a controller 155 couple to the high pressure switch may compare a pressure of the refrigerant to a predetermined operational maximum. Operation of the air conditioner at pressures greater than the predetermined operational maximum may cause mechanical failure, including pre-failure events (e.g., excessive wearing that may lead to mechanical failure), of one or more components of the air conditioner (e.g., lines, seals, welds, compressor, and/or condenser). For example, operation of the air conditioner at pressures greater than approximately 615 psig and/or greater than approximately 620 psig may cause mechanical failure of at least a portion of the air conditioner. The high pressure switch 150 may restrict operation of at least a portion of the air conditioner if it is determined that the pressure exceeds the predetermined operational maximum. For example, during use, if the pressure proximate the high pressure switch exceeds the predetermined maximum, then operation of the compressor may be restricted (e.g., the compressor may be shut off).

In some implementations, when the air conditioner includes a condenser that it not a microchannel condenser, high pressures (e.g., greater than predetermined maximum and/or predetermined operational maximum) may not occur (e.g., during high ambient temperature operations) due to the smaller capacity difference between the condenser and the evaporator (e.g., when compared to the capacity difference between a microchannel condensers and an evaporator).

Although the high pressure portion 105 and the low pressure portion 110 are illustrated in FIGS. 1, 2, and 3 as including and/or not including various components, other configurations may be utilized in the air conditioning system 100, 200, 300. For example, in some implementations, at least a portion of the expansion valve may be included in the high pressure portion and/or the low pressure portion. At least a portion of the compressor may be included in the high pressure portion and/or the low pressure portion.

Although the high pressure switch is illustrated as disposed between the sensor and the inlet of the high pressure portion of the air conditioning system, the high pressure switch may be disposed in other portions of the air conditioning system. For example, the high pressure switch may be disposed proximate an outlet of the compressor, and/or proximate an outlet of the condenser.

Figure 4:
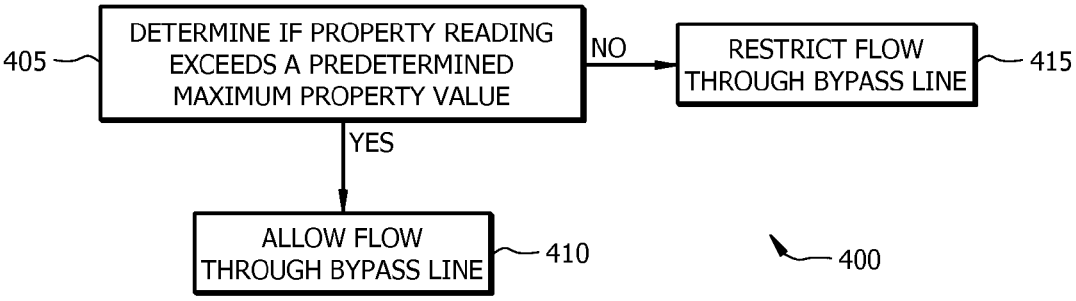
FIG. 4 illustrates an implementation of an example process for operation of an air conditioner.

FIG. 4 illustrates an implementation of an example process 400 for an operation of an air conditioning system. During use of an air conditioning system, a determination may be made whether a property reading exceeds a predetermined maximum property (operation 405). For example, a sensor positioned in at least a portion of the air conditioner may measure a property (e.g., temperature, pressure, temperature differential, and/or pressure differential, such as a pressure difference over time or a pressure difference between two points in the system) of the air conditioner. The sensor may be a portion of a control device (e.g., such as a smart valve and/or air conditioner controller). The property reading may be at least partially based on the measured property. For example, the property reading may be the measured property and/or a differential of the measured property and one additional measured property. A memory of the air conditioner may store the predetermined maximum property. The predetermined maximum property may be retrieved from the memory and/or the property reading may be compared to a predetermined maximum property.

If the property reading exceeds the predetermined maximum property, flow through the bypass line may be allowed (operation 410). For example, the controller may transmit a signal to a valve disposed in the bypass line. The valve may at least partially open if the property reading exceeds the predetermined maximum property. In some implementations, the amount of refrigerant allowed to flow through the bypass line may be based at least partially on the degree of openness of the valve. The amount of refrigerant allowed to flow through the bypass line may be based on the size of the bypass line. Allowing fluid flow through the bypass line may reduce a pressure of at least a part of the high pressure portion of the air conditioner.

If the property reading does not exceed the predetermined maximum property, flow through the bypass line may be restricted (operation 415). For example, a valve disposed in the bypass line may be closed if the property reading is does not exceed the predetermined maximum property.

Process 400 may be implemented by various systems, such as system 100, 200, and 300. In addition, various operations may be added, deleted, or modified. For example, a sensor may measure a property differential. In some implementations, the valve may automatically open and/or close based on determined property readings. For example, the valve may automatically open when a property reading is greater than a predetermined maximum property. The valve may automatically close when a property reading is less than a predetermined closing value for the property. In some implementations, the predetermined closing value may be less than the predetermined maximum value (e.g., the valve may open at a high pressure than the pressure at which the valve closes). In some implementations, the valve may automatically open when the property exceeds a predetermined property value and automatically close when the property is less than approximately the predetermined value. The sensor and valve may be a single unit (e.g., a smart valve), in some implementations.

In some implementations, the bypass line may couple at least a portion of the high pressure portion to at least one other portion of the air conditioner. For example, the bypass line may couple a line proximate an outlet of the compressor to a line proximate an inlet of the compressor. The bypass line placement in the air conditioner may depend on the phase of the refrigerant entering the inlet of the bypass line. The bypass line may couple two portions of the air conditioning system, where the refrigerant is at least partially in the same phase (e.g., liquid and liquid, liquid and gas/liquid mixture, and/or gas and gas).

In some implementations, the bypass may divert a portion of the refrigerant in a line proximate an outlet of the high pressure portion to a line proximate an inlet of the low pressure portion. For example, the bypass may allow a portion of the refrigerant to flow to the low pressure portion without flowing through an expansion valve. In some implementations, the bypass may divert a portion of the refrigerant in a line proximate an inlet of the high pressure portion to a line proximate an outlet of the low pressure portion.

Figure 5:
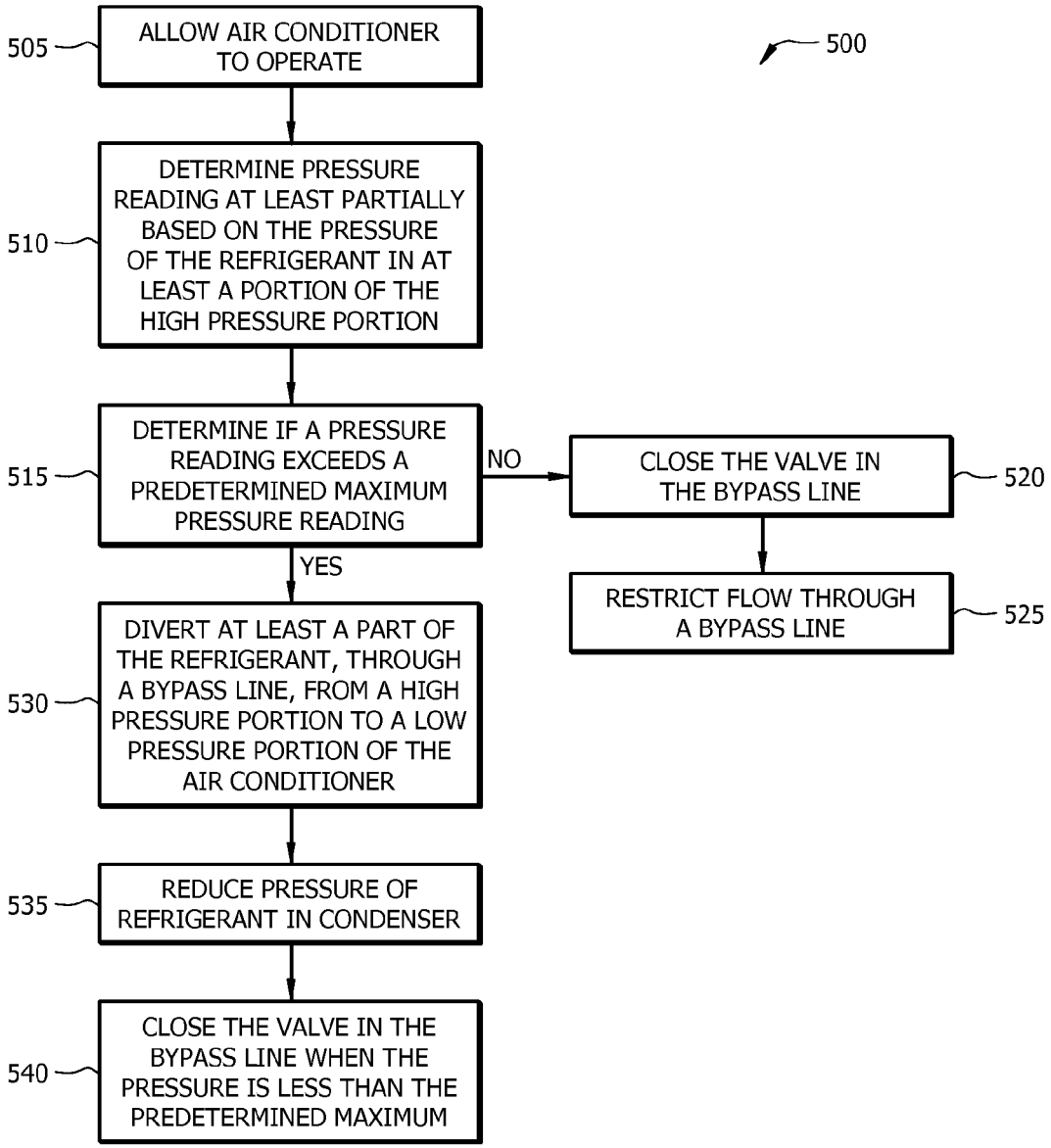
FIG. 5 illustrates an implementation of an example process for operation of an air conditioner.

FIG. 5 illustrates an implementation of an example process 500 for an operation of an air conditioning system. Operation of an air conditioning system may be allowed (operation 505). For example, an air conditioner with a microchannel condenser may receive requests for operation from a user and operate based on the received requests.

A pressure reading based at least partially on the pressure of the refrigerant in at least a portion of the high pressure portion may be determined (operation 510). For example, a sensor may be coupled proximate an inlet of the high pressure portion and determine a pressure reading. The sensor may be coupled to and/or a portion of a controller. The inlet of the high pressure portion may be a proximate an outlet of the compressor, proximate an inlet of the condenser, and/or disposed in a line coupling the compressor and the condenser, in some implementations. The pressure reading may be determined based on measurements by the sensor. The pressure reading may be a pressure and/or a pressure differential. For example, the pressure may be a pressure proximate an inlet of a high pressure portion (e.g., proximate an outlet of a compressor). A pressure reading may be a pressure differential across a components, such as a compressor and/or a condenser.

A determination may be made whether a pressure reading exceeds a predetermined maximum pressure reading (operation 515). For example, a predetermined maximum pressure reading may be retrieved from a memory of the air conditioner. The pressure reading and the predetermined reading may be compared (e.g., by a processor of the controller of the air conditioner, by a valve controller, and/or by the sensor). In some implementations, the pressure reading may be a pressure differential of across the compressor and the predetermined maximum pressure differential across the compressor may be 460 psi for R410A. The pressure reading may be an absolute pressure and the predetermined maximum pressure may be 600 psig. For example, a pressure of refrigerant in a line may be a measured pressure reading and the associated predetermined maximum pressure reading may be 600 psig. In some implementations, the predetermined maximum pressure may be a preselected amount (e.g., 10 psi, 15 psi, and/or 20 psi) less than the maximum operational pressure (e.g., the pressure at which a high pressure switch restricts operation of at least a portion of the air conditioning system to inhibit mechanical failure of the system). The predetermined maximum pressure may be selected such that operation of the high pressure switch may be avoided when using the bypass line.

If the pressure reading does not exceed the predetermined maximum pressure reading, the valve in the bypass line may be closed (operation 520) and flow through the bypass line may be restricted (operation 525). For example, a controller and/or the sensor may transmit a signal to the valve indicating that the valve be closed. The flow through the bypass line may be restricted by a valve (e.g., solenoid valve) disposed in the bypass line and/or coupled (e.g., through Wi-Fi) to the pressure sensor. For example, during at least some operations of the air conditioning system (e.g., normal operations when ambient temperatures are not elevated), a portion of the refrigerant may not be diverted through the bypass line.

If the pressure reading does exceed the predetermined maximum pressure reading, at least a part of the refrigerant may be diverted from at least a portion of the high pressure portion to at least a portion of the low pressure portion through a bypass line (operation 530). The amount of refrigerant diverted to the bypass line may be based on the size of the bypass line (e.g., diameter) and/or the openness of a valve disposed in the bypass line. The amount of the refrigerant diverted may be less than approximately 50 percent of the total amount of refrigerant in the air conditioning system, in some implementations. The amount of refrigerant diverted may be approximately 5 percent to approximately 10 percent of the total amount of refrigerant in the air conditioning system. The amount of refrigerant diverted may be approximately 10 percent to approximately 20 percent of total amount of refrigerant in the air conditioning system.

In some implementations, the bypass may divert a portion of the refrigerant in a line proximate an outlet of the compressor to a line proximate an inlet of the compressor. A pressure exceeding the maximum operational pressure may be inhibited and so the air conditioner may continue to operate during the high pressure conditions (e.g., high ambient temperature) rather than being restricted from operations.

In some implementations, the bypass may divert a portion of the refrigerant in a line proximate an outlet of the condenser to a line proximate an inlet of the evaporator. Operation of the air conditioner may be allowed despite high pressures (e.g., as opposed to restricted operations caused by activation of the high pressure switch. Bypassing the expansion valve may not substantially affect the efficiency of the air conditioner (e.g., the efficiency may vary by less than approximately 5 percent).

A pressure of the refrigerant in at least a portion of the condenser may be reduced (operation 535). Allowing a part of the refrigerant to be diverted through the bypass line may reduce the pressure of at least part of the high pressure portion (e.g., when compared with the pressure of the high pressure portion when flow through the bypass is restricted). For example, a pressure of the condenser (e.g., pressure proximate an inlet, pressure proximate an outlet, and/or pressure across the condenser) or portions thereof may be reduced. When the pressure of a portion of the high pressure portion, such as the condenser, is reduced, the pressure proximate the high pressure switch may not exceed the activating pressure of the high pressure switch and/or the restriction of operation of components of the air conditioning system may be inhibited.

In some implementations, when the bypass diverts a portion of the refrigerant in a line proximate an outlet of the compressor to a line proximate an inlet of the compressor, the pressure of the refrigerant proximate an inlet of the condenser and/or high pressure portion may be reduced. When the bypass diverts a portion of the refrigerant in the line proximate the outlet of the condenser to a line proximate an inlet of the evaporator, the pressure of the refrigerant in the condenser may be reduced.

In some implementations, when the pressure is less than a predetermined closing pressure, the valve may be closed (operation 540). The valve may be closed automatically. Closing the valve may restrict flow through the bypass line. In some implementations, the predetermined closing pressure may be a predetermined amount less than the predetermined maximum pressure value (e.g., approximately 20 psig, approximately 10 psig, and/or approximately the same as the predetermined maximum pressure value).

Process 500 may be implemented by various systems, such as system 100, 200, and 300. In addition, various operations may be added, deleted, or modified. Various operation of process 400 and/or 500 may be combined and/or modified. For example, a pressure reading may be a pressure differential across more than one component. The pressure may be reduced in at least a part of the high pressure portion.

In some implementations, high property events (e.g., high temperature events and/or high pressure events) may be identified. For example, predetermined values for properties may be associated with high property events and when the properties of the air conditioning system are measured and compared with the predetermined values for the properties, the high property events may be identified. A valve in the bypass line may operate based on the identification of high property events. For example, when a high property event is identified, a valve may open to allow fluid flow through the bypass line. Once the high property event is no longer occurring, the valve may close to restrict fluid flow through the bypass line.

In some implementations, the air conditioner may include more than one bypass line. When pressure readings or other measured property readings exceed a predetermined maximum property, refrigerant may be diverted to one or more of the bypass lines. In some implementations, a valve in a first bypass line may be opened and if the property reading still exceeds the predetermined maximum property, then one or more additional bypass lines may be opened in addition to and/or while restricting fluid flow through the first bypass line.

In some implementations, the valve may be a mechanical valve. The valve may act as a sensor and may be coupled such that a pressure reading (e.g., a pressure differential across a component) may be determined and the valve may automatically open and/or close based on the determined pressure reading.

In some implementations, the bypass line may automatically allow a portion of the refrigerant to be diverted. For example, the bypass line may include an orifice that controls the amount of refrigerant allowed to pass through the bypass line. In some implementations, the bypass line may not include a valve.

In some implementations, in an air conditioner that includes a microchannel condenser, as the ambient temperature becomes elevated (e.g., ambient temperatures greater than 125 degrees Fahrenheit and/or 116 degrees Fahrenheit), the pressure in the microchannel condenser increases (e.g., due to the capacity differences between the evaporator and the microchannel condenser). A sensor in disposed proximate at least a portion of the condenser may measure the pressure (e.g., pressure reading). As the pressure (e.g., inlet, outlet, differential, and/or average) of the microchannel increases, the likelihood of mechanical failure increases, and so a high pressure switch may operate at a predetermined activation pressure (e.g., a maximum operational pressure) to inhibit mechanical failure of the air conditioner. For example, the high pressure switch may restrict operation of one or more components of the air conditioner (e.g., compressor) and/or open a vent. The predetermined maximum pressure may be determined based on the high pressure switch activation pressure, in some implementations. For example, the predetermined maximum pressure may be a predetermined amount less than the maximum operational pressure (e.g., the predetermined maximum pressure maybe approximately 15 to approximately 20 psi less than the predetermined maximum operational pressure). The measured pressure may be compared to the predetermined maximum pressure to determine whether to allow a part of the refrigerant to be diverted to the bypass line. When the measured pressure exceeds the predetermined maximum pressure, a valve coupled to the sensor may open and allow refrigerant to flow through the bypass line. The bypass may reduce the pressure and/or inhibit pressures in the microchannel condenser from elevating to the activation pressure. When the measured pressure does not exceed the predetermined maximum pressure, fluid flow through the bypass line may be restricted (e.g., by the valve coupled to the sensor). For example, the bypass line may be utilized to reduce the pressure, when needed to control pressure in the microchannel condenser and/or to inhibit mechanical failure. When the pressure of the microchannel condenser is within operational parameters (e.g., less than the predetermined maximum pressure and/or predetermined maximum operational pressure), the fluid flow through the bypass line may be restricted to increase efficiency of the system and/or control of pressure within the evaporator.

Although various implementations have been described in terms of pressure and pressure sensors, other properties may be utilized in the various systems and/or processes. For example, a temperature sensor may be utilized. Temperatures, such as ambient temperature may be measured by sensors and the valve in the bypass line may operate based on the measured temperature.

Although a valve coupled to the bypass line that opens to allow fluid flow through the bypass line has been described, other valve configurations may be allowed as appropriate. For example, a three way valve coupled to the junction between the bypass line and the high pressure portion and/or low pressure portion, may direct fluid flow.

In some implementations, ambient temperature may include a temperature proximate the high pressure portion, a temperature proximate the condenser, and/or a temperature proximate a condenser fan. For example, ambient temperature may include a measure of the temperature of the air proximate an outdoor portion (e.g., a condenser) of an air conditioning system. As another example, ambient temperature may include a measure of the temperature of a fluid removing heat from the refrigerant in the condenser.

In some implementations, a pressure across a line coupling components may be substantially constant. For example, a pressure drop across a line coupling components may be less than approximately 5 percent. As an example, a pressure proximate an inlet of a high pressure portion and/or condenser may be substantially equal to the pressure proximate an outlet of a compressor. A sensor measuring a pressure in a line may not substantially affect the pressure.

In some implementations, a pressure across the high pressure portion and/or the pressure across the low pressure portion may be substantially constant. For example, a pressure drop across the high pressure portion may be less than approximately 5 percent. The pressure drop across the low pressure portion may be less than approximately 5 percent.

Although an expansion valve has been described, any appropriate metering device may be utilized to control fluid flow into the evaporator. For example, a thermal expansion valve may be utilized.

A line may include any appropriate tubing and/or conduit for fluid flow.

Although an operation of the cycle is described where cool air is provided to a location by the evaporator which is the indoor coils, the cycle may be reversed such that hot air is provided to a location by the indoor coils. For example, heat may transfer from refrigerant in the indoor coils to the air from the indoor blower.

In some implementations, the air conditioning system may include a controller. The control device for the bypass valve may be a portion of the controller and/or separate from the controller. A controller may be coupled to various components of the air conditioning system. For example, the controller may be communicably coupled to an evaporator, an evaporator blower, a compressor, a condenser, a condenser fan, bypass line, sensor, high pressure switch, control device of the sensor, valve, and/or thermal expansion valve. The controller may be a computer or other programmable logic device.

The controller may include a processor that executes instructions and manipulates data to perform operations of the controller and a memory. The processor may include a programmable logic device, a microprocessor, or any other appropriate device for manipulating information in a logical manner and memory may include any appropriate form(s) of volatile and/or nonvolatile memory, such as a repository.

A memory may include data, such as predetermined maximum operating properties (e.g., temperatures and/or pressures), activation pressures, predetermined maximum properties (e.g., temperatures and/or pressures), periods of time that operations should run, and/or any other data useful to the operation of the air conditioner. In addition, various types of software may be stored on the memory. For example, instructions (e.g., operating systems and/or other types of software), an operation module, a bypass operation module, and/or a high pressure switch module may be stored on the memory. The operation module may operate the air conditioner during normal operations (e.g., operations based at least partially on requests for operation from a user, operations in which flow though the bypass is restricted). The bypass operation module may measure and/or monitor properties of the air conditioning system, retrieve data (e.g., predetermined operational maximums and/or predetermined maximum values), compare data to monitored properties, determine whether to open and/or close a bypass line, etc. A high pressure switch module may measure and/or monitor properties, such as pressure; retrieve data (e.g., predetermined operational maximum); compare monitored properties to retrieved data, and/or determine an appropriate action based on the retrieved data (e.g., restrict operation of one or more components of the air conditioner and/or allow normal operations).

A communication interface may allow the controller to communicate with components of the air conditioner, other repositories, and/or other computer systems. The communication interface may transmit data from the controller and/or receive data from other components, other repositories, and/or other computer systems via network protocols (e.g., TCP/IP, Bluetooth, and/or Wi-Fi) and/or a bus (e.g., serial, parallel, USB, and/or FireWire).

The controller may include a presentation interface to present data to a user. For example, to provide for interaction with a user, the systems and techniques described here can be implemented on a computer having a display device (e.g., a CRT (cathode ray tube) or LCD (liquid crystal display) monitor) for displaying information to the user and a keyboard and a pointing device (e.g., a mouse or a track pad) by which the user can provide input to the computer. Other kinds of devices can be used to provide for interaction with a user as well; for example, feedback provided to the user by an output device can be any form of sensory feedback (e.g., visual feedback, auditory feedback, or tactile feedback); and input from the user can be received in any form, including acoustic, speech, or tactile input.

The controller may include clients and servers. A client and server are generally remote from each other and typically interact through a communication network. The relationship of client and server arises by virtue of computer programs running on the respective computers and having a client-server relationship to each other.

A client may allow a user to access the controller and/or instructions stored on the controller. The client may be a computer system such as a personal computer, a laptop, a personal digital assistant, a smart phone, or any computer system appropriate for communicating with the controller.

These computer programs (also known as programs, software, software applications or code) include machine instructions for a programmable processor, and can be implemented in a high-level procedural and/or object-oriented programming language, and/or in assembly/machine language. As used herein, the term "machine-readable medium" refers to any computer program product, apparatus and/or device (e.g., magnetic discs, optical disks, memory, Programmable Logic Devices (PLDs)) used to provide machine instructions and/or data to a programmable processor, including a machine-readable medium that receives machine instructions as a machine-readable signal. The term "machine-readable signal" refers to any signal used to provide machine instructions and/or data to a programmable processor.

Although users have been described as a human, a user may be a person, a group of people, a person or persons interacting with one or more computers, and/or a computer system. Various implementations of the systems and techniques described here can be realized in digital electronic circuitry, integrated circuitry, specially designed ASICs (application specific integrated circuits), computer hardware, firmware, software, and/or combinations thereof. These various implementations can include implementation in one or more computer programs that are executable and/or interpretable on a programmable system including at least one programmable processor, which may be special or general purpose, coupled to receive data and instructions from, and to transmit data and instructions to a storage system (e.g., repository), at least one input device, and at least one output device.

It is to be understood the implementations are not limited to particular systems or processes described which may, of course, vary. It is also to be understood that the terminology used herein is for the purpose of describing particular implementations only, and is not intended to be limiting. As used in this specification, the singular forms "a", "an" and "the" include plural referents unless the content clearly indicates otherwise. Thus, for example, reference to "a line" includes a combination of two or more lines and reference to "a compressor" includes different types and/or combinations of compressors. As another example, "coupling" includes direct and/or indirect coupling of members. For example, a sensor may be directly coupled to a valve. A sensor may be wirelessly coupled to a valve, such that a signal may be transmitted to the valve, in some implementations.

Although the present disclosure has been described in detail, it should be understood that various changes, substitutions and alterations may be made herein without departing from the spirit and scope of the disclosure as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure, processes, machines, manufacture, compositions of matter, means, methods, or steps, presently existing or later to be developed that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps.

The invention claimed is:

1. An air conditioning system comprising:

a high pressure portion comprising a microchannel condenser;

a low pressure portion, wherein a pressure of a refrigerant in at least a portion of the high pressure portion is greater than a pressure of refrigerant in at least a portion of the low pressure portion;

a property sensor configured to detect a property reading, wherein the property reading is at least partially based on a property of the refrigerant in at least a portion of the high pressure portion;

a bypass line coupling at least a part of the high pressure portion and a part of the low pressure portion, and wherein opening the bypass line reduces a pressure of at least a portion of the microchannel condenser; and a valve coupled to the bypass line, wherein the valve is adapted to open at least partially based on the pressure reading.

2. The system of claim of 1 wherein a property reading includes at least one of a temperature, a pressure, a temperature differential, or a pressure differential, a change in temperature, or a change in pressure.

3. The system of claim 1 further comprising a compressor wherein the property reading comprises a pressure differential between a pressure of the refrigerant proximate an inlet of the compressor and a pressure of the refrigerant proximate an inlet of the high pressure portion, wherein the inlet of the high pressure portion is proximate an outlet of the compressor.

4. The system of claim 1 wherein the property reading comprises a pressure differential between a portion of the high pressure portion and a portion of the low pressure portion.

5. The system of claim 1 further comprising a compressor, wherein the bypass line couples a first line proximate an outlet of the compressor and a second line proximate an inlet of the compressor, wherein the high pressure portion comprises at least a portion of the first line, and wherein the low pressure portion comprises at least a portion of the second line.

6. The system of claim 1 wherein the bypass line couples a first line proximate an outlet of the microchannel condenser and second line proximate an inlet of an evaporator of the low pressure portion, wherein the high pressure portion comprises at least a portion of the first line, and wherein the low pressure portion comprises at least a portion of the second line.

7. The system of claim 1 wherein the valve is configured to automatically open when the property reading exceeds a predetermined maximum property.

8. The system of claim 1 wherein the valve is configured to automatically close when the property reading is below a predetermined closing value for a property.

9. The system of claim 1, wherein the valve is configured to open when the pressure reading exceeds a predetermined maximum property, and wherein the valve is configured to close when the property reading is less than approximately the predetermined maximum property.

10. A method comprising:

determining a pressure reading at least partially based on a pressure of refrigerant in at least a portion of a high pressure portion of an air conditioner, wherein the high pressure portion comprises a microchannel condenser;

determining if the pressure reading exceeds a predetermined maximum pressure;

allowing a part of the refrigerant in the high pressure portion to flow to a low pressure portion of the air conditioner through a bypass line;

allowing the pressure in at least a part of the microchannel condenser to be reduced by allowing the part of the refrigerant to flow through the bypass line.

11. The method of claim 10 further comprising restricting a flow of the refrigerant through the bypass line, if the pressure reading does not exceed a predetermined maximum pressure.

12. The method of claim 10 further comprising automatically closing a valve disposed in the bypass line when the pressure reading does not exceed the predetermined maximum pressure.

13. The method of claim 10 wherein determining the pressure reading comprises measuring a pressure differential between an outlet of a compressor of the air conditioner and an inlet of the compressor.

14. The method of claim 10 further comprising transmitting a signal to a valve disposed in the bypass line based on the determination of whether the pressure reading exceeds a predetermined maximum pressure.

15. The method of claim 10 wherein allowing a part of the refrigerant in the high pressure portion to flow to the low pressure portion through the bypass line comprises allowing a part of the refrigerant in a first line proximate an outlet of a compressor of the air conditioner to flow to a second line proximate an inlet of the compressor.

16. The method of claim 10 wherein allowing a part of the refrigerant in the high pressure portion to flow to the low pressure portion through the bypass line comprises allowing a part of the refrigerant in a first line proximate an outlet of the condenser to flow to a second line proximate an inlet of an evaporator of the air conditioner.

17. A method comprising:

determining a property reading of an air conditioner comprising a microchannel condenser;

determining if the property reading exceeds a predetermined maximum property;

allowing a part of the refrigerant in a high pressure portion of the air conditioner to flow to a low pressure portion of the air conditioner through a bypass line, if the property reading exceeds the predetermined maximum property; and allowing a pressure in at least a part of the condenser to be reduced by allowing the part of the refrigerant to flow through the bypass line.

18. The method of claim 17 wherein the property reading comprises at least one of ambient temperature, temperature of the refrigerant proximate an outlet of a compressor of the air conditioner, temperature of the refrigerant proximate an inlet of the condenser, pressure of the refrigerant proximate an outlet of the compressor, or pressure of the refrigerant proximate an inlet of the condenser.

19. The method of claim 17 further comprising restricting a flow of the refrigerant through the bypass line, if the pressure reading does not exceed the predetermined maximum pressure.

20. The method of claim 17 wherein allowing a part of the refrigerant in the high pressure portion to flow to the low pressure portion through the bypass line comprises at least one of:

allowing a part of the refrigerant in a first line proximate an outlet of a compressor of the air conditioner to flow to a second line proximate an inlet of the compressor; or allowing a part of the refrigerant in a first line proximate an outlet of the condenser to flow to a second line proximate an inlet of an evaporator of the air conditioner.

* * * * *